US005085273A

United States Patent [19]

Coone

[11] Patent Number: 5,085,273

[45] Date of Patent: Feb. 4, 1992

[54] CASING LINED OIL OR GAS WELL

[75] Inventor: Malcolm G. Coone, Katy, Tex.

[73] Assignee: Davis-Lynch, Inc., Houston, Tex.

[21] Appl. No.: 593,686

[22] Filed: Oct. 5, 1990

[51] Int. Cl.[5] ..... E21B 17/08; E21B 33/14; F16L 27/12

[52] U.S. Cl. ..... 166/242; 166/285; 285/3; 285/165; 285/302

[58] Field of Search ..... 166/242, 285, 381; 285/302, 298, 138, 140, 3, 165

[56] References Cited

U.S. PATENT DOCUMENTS 2,712,854 7/1955 Creighton ..... 285/3 X
2,900,028 8/1959 Hanes ..... 285/302 X
3,399,548 9/1968 Burns ..... 285/302 X
3,531,236 9/1970 Braddick et al. ..... 285/302 X
3,936,080 2/1976 Bennett ..... 285/302 X
4,285,533 8/1981 Silberman et al. ..... 285/3 X

*Primary Examiner*—Stephen J. Novosad
*Attorney, Agent, or Firm*—Vaden, Eickenroht Thompson & Boulware

[57] ABSTRACT

There is disclosed an oil or gas well having a well bore which penetrates a production zone and a casing string which is anchored in the well bore by a column of cement bonded to the casing string and well bore. Connectors are installed as part of the casing string to permit portions thereof opposite the production zone and above the production zone to be respectively contracted or extended in response to subsidence or other causes of axial loading of the string through the cement column.

11 Claims, 5 Drawing Sheets

CASING LINED OIL OR GAS WELL

This invention relates generally to improvements in an oil or gas well in which a well bore is penetrated by a production zone and a casing string is anchored within the well bore by a column of cement bonded to the string and well bore.

In wells of this type, the casing string and the column of cement surrounding the string opposite the production zone are perforated to permit production fluid from the zone to flow into the casing string. Ordinarily, the production fluid flows upwardly to the well head through a tubing string which is suspended within the casing string, the annulus between the tubing and casing strings being packed off above the production zone to confine production fluids in the casing string for flow into the open lower end of the tubing string. During completion of and production from the well, it is necessary to install not only the tubing string and packer, but also other objects such as pumps, gas lift equipment and the like within the casing string.

As fluids are produced from the zone, it becomes unstable and may subside due to the weight of the overburden of earth above it, thus placing the zone in compression. Due to the tight bond of the cement column to the casing string and well bore, the portion of the casing string opposite the zone may thus be subjected to compression and the portion of the casing string above the zone subjected to tension. This may cause the casing string to buckle or part and thus prevent normal production from the well and damage to equipment within it.

The primary object of the invention is to provide a well of this type in which the casing string is of such construction as to avoid these problems in the event of subsidence or other phenomenon tending to subject the casing string to axial loadings through the cement column bonded thereto.

Another object is to provide connectors for installation as a part of such a casing string which are capable of expanding or contracting, as required, without damage to the string, and, more particularly, which are of such construction as to neither enlarge upon the maximum outer diameter nor restrict the minimum diameter of the casing strings in which they are installed.

Still another object is to provide such connectors which are so constructed as to permit relatively large degrees of extension or contraction without unduly reducing the resistance of the connectors and thus the casing string to bending.

These and other objects are accomplished, in accordance with the illustrated embodiments of the invention, by means of a connector having first and second tubular members whose outer ends are adapted to be connected in alignment with portions of the casing string, the first member having its inner end telescopically and sealably reciprocable within the inner end of the second member between contracted and extended positions, and the members having means thereon engagable with one another to locate the first member in each of its contracted and extended positions. More particularly, the members are connected in one of such positions and the first member has an outer conical surface which is flared in the direction toward which the first member is moved from its one position to its other position, the connection between the members being releasable to permit the conical surface to move away from the adjacent portions of this cement column in response to axial loading of the casing string, as may occur in the case of subsidence. This then creates a void between the surface and the cement column in which cement particles may collect, if, for example, a portion of the column is crushed by a collar of the shifting casing string.

As shown in each of the illustrated embodiments of the invention, the end of the first member has a piston which carries seal means slidable within an enlarged inner cylindrical surface of the second member, and the second member has oppositely facing shoulders on its enlarged inner cylindrical surface with which the opposite ends of the piston are engagable to locate the first tubular member in its contracted and extended positions. More particularly, the maximum outer diameters of the second tubular member and the conical surface of the first tubular member are generally axially aligned, and the minimum inner diameters of the first and second members are generally aligned with those of the casing string portions to which they are connected, whereby the radial dimensions of the connector are minimal and need not necessarily exceed the radial dimensions of the remainder of the casing string.

In one embodiment of the invention, wherein the connector is installed in a portion of the casing string opposite the well bore above the production zone, the first member is releasably connected to the second member in its contracted position, and the conical surface is flared downwardly so as to pull away from adjacent surfaces of the cement column when such portion of the casing string is placed in tension. In another embodiment of the invention, the connector is adapted to be installed within a portion of the casing string which is opposite the production zone, the first member is releasably connected to the second member in its extended position, and the conical surface is flared downwardly so as to pull away from the adjacent surface of the cement column when the portion of the casing string in which it is installed is placed in compression.

In certain embodiments of the invention, the connector also includes a third tubular member having an end telescopically and sealably reciprocable within the opposite end of the second member between contracted and expanded positions, and means are provided for connecting the third member in either its contracted or extended position, depending on whether the connector is of the extendable type, in which case the third member like the first member is connected in its contracted position, or is of the contractible type, wherein the third member, like the first member, is connected in its extended position. In either event, the third member is, like the first member, provided with an outer conical surface which is flared in the direction toward which such third member is moved from the position in which it is connected to the second member, and the connection is releasable to permit the conical surface to move away from the adjacent surface of the cement column, in response to axial loading of the casing string, either in tension, in the case of the extendable connector, or in compression in the case of the contractible connector. Thus, in these latter described embodiments of the invention, the second tubular member may be substantially longer and provided with shoulders on an intermediate portion of its inner cylindrical surface for engagement with piston means on the ends of each of the first and third members to locate them in either contracted or extended positions. Consequently, the overall connector may extend or contract to a substantially greater extent than in the case of the connector embodiments having only first and second tubular members, but without decreasing the resistance of the connector to bending by reducing its L/R radio. Thus, for example, the second member need only be increased in axial length substantially twice in order to permit substantially twice the amount of axial extension or contraction of the overall connector.

In its preferred and illustrated embodiment, the invention contemplates that at least one extendable connector will be installed in the portion of the casing above the production zone, and at least one contractible connector will be installed in the portion of the casing string opposite the production zone. Consequently, the connectors make it possible for the upper portion of the casing string to be placed in tension, and the portion thereof opposite the production zone to be placed in compression. Obviously, there may be more than one such connector installed within each portion of the casing string, and the connectors may be of the two member or three member variety, depending upon the anticipated length of axial extension of contraction of the portion of the casing string in which they are installed.

In the drawings, wherein like reference characters are used throughout to indicate like parts:

FIG. 1 is a vertical sectional view of a lower portion of an oil or gas well having a well bore which penetrates a production zone and in which a casing string is anchored by means of a cement column bonded to it and the well bore, the string including an extendable connector installed in the portion thereof above the production zone and a contractible connector installed in a portion thereof opposite the production zone;

Figure 6A:
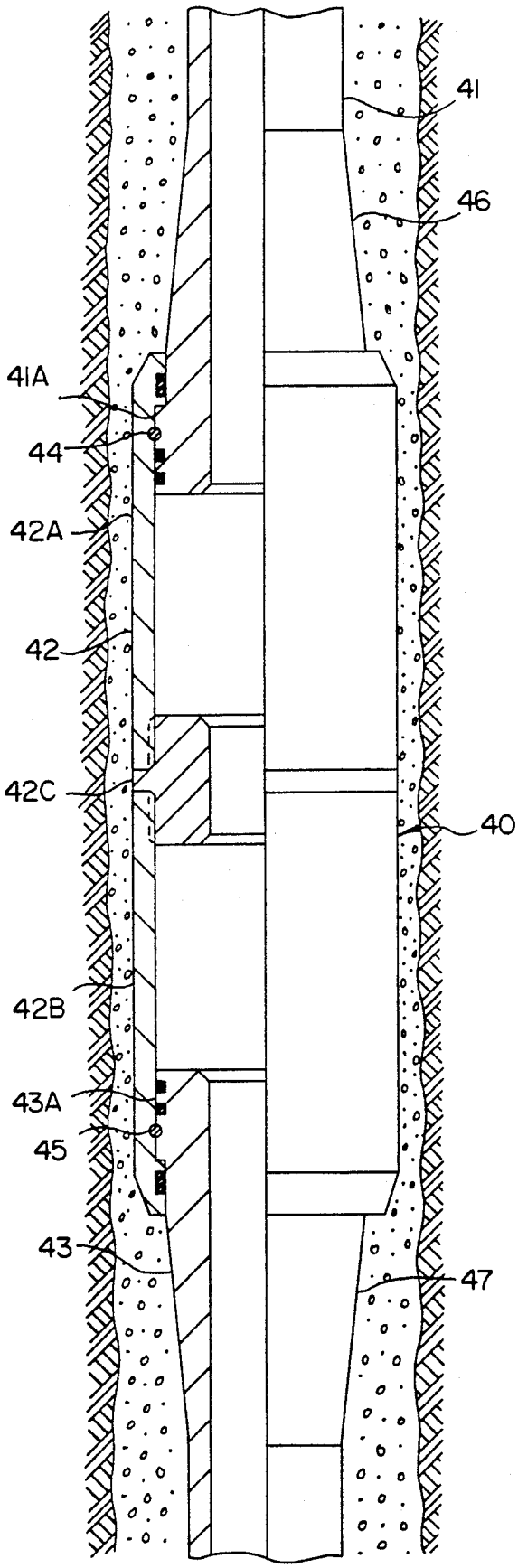
Figure 6B:
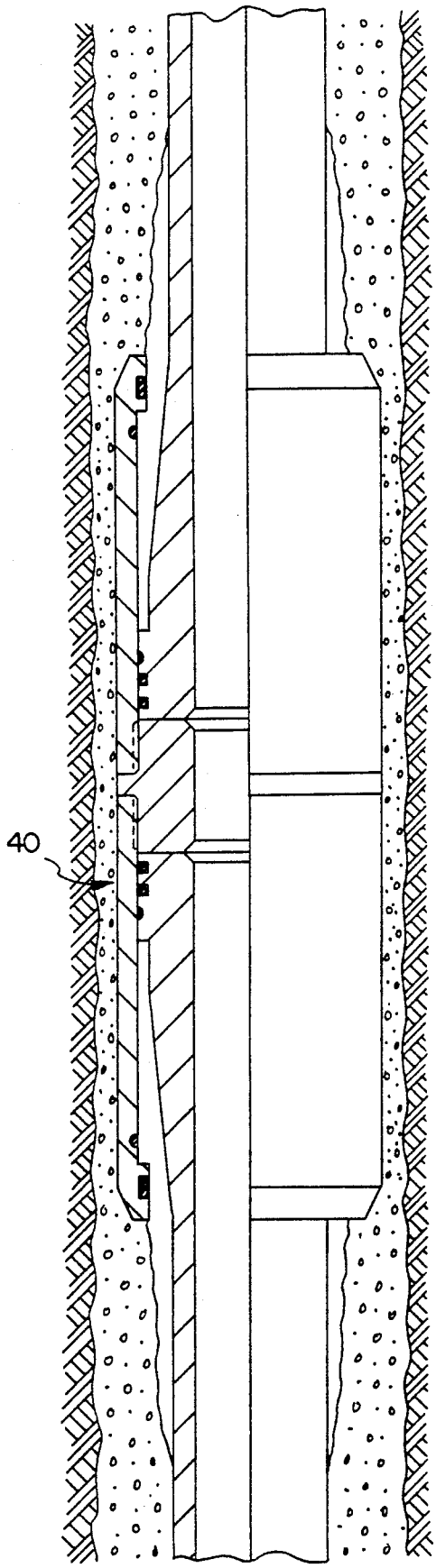
Figure 7C:
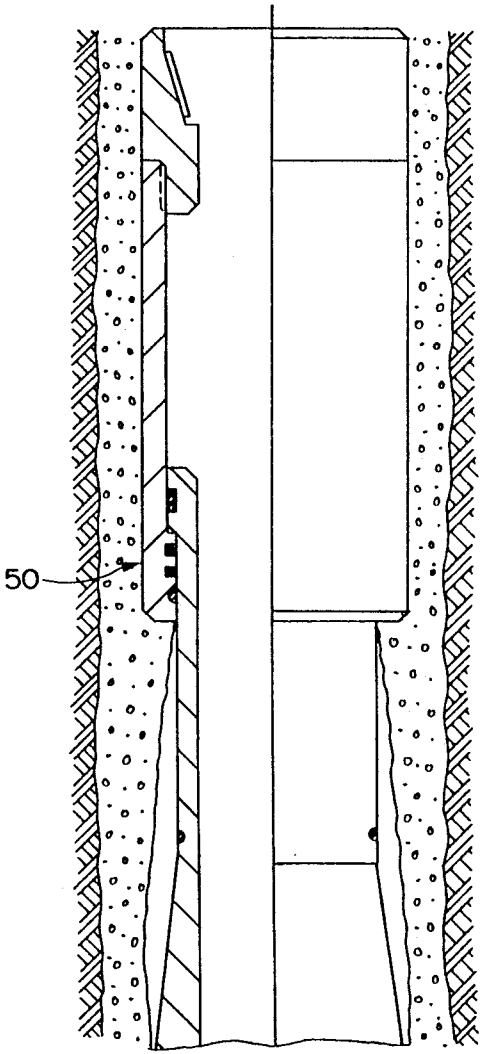
Figure 7B:
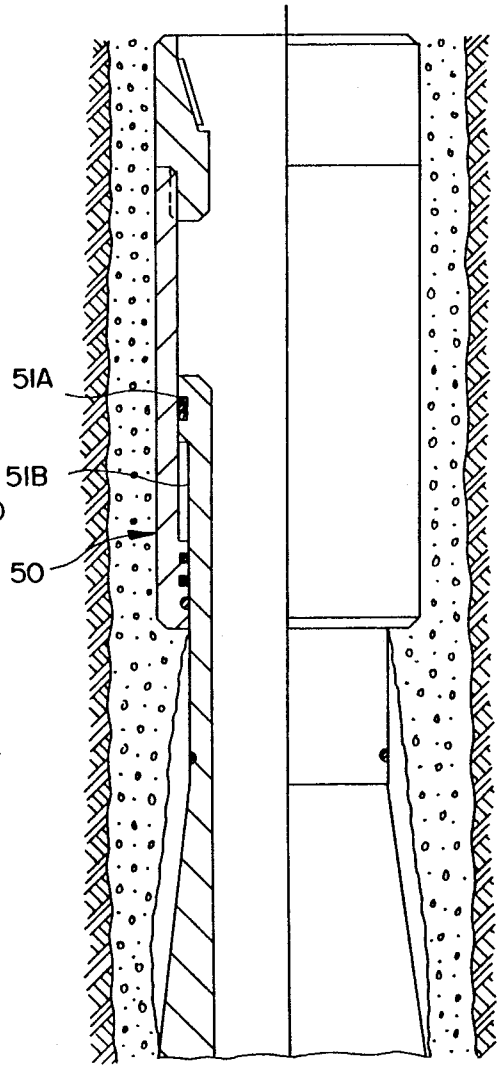
Figure 7A:
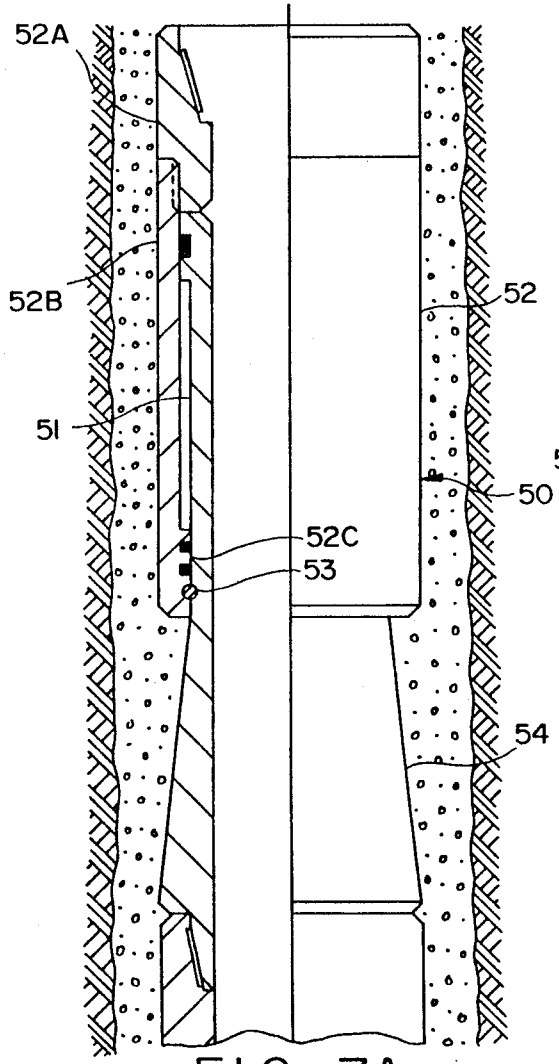

FIGS. 6A and 6B are detailed views, partly in elevation, and partly in section, of an alternative form of a contractible connector having first and third tubular members telescopically arranged with respect to a second member and in their extended positions, as shown in FIG. 6A, and in their contracted positions, as shown in FIG. 6B, following compression of the portion of the casing string in which the connector is installed; and FIGS. 7A, 7B and 7C are detailed views, partly in elevation and partly in section, of an alternative embodiment of an extendable connector, FIG. 7A showing the first and second tubular members thereof connected in contracted positions, FIG. 7B showing the first member released from connection to the second member and moved to an intermediate position in response to axial loading of the casing string, and FIG. 7C showing the connector with the first and second members in their fully extended positions.

With reference now to the details of the above described drawings, the well of FIG. i is shown to comprise a well bore 20 which penetrates a production zone 21 a substantial distance beneath the surface of the wellhead (not shown) and a casing string 22 which is anchored in the well bore by means of a column 23 of cement bonded to the casing string and the well bore. As previously described, the casing string is subject to axial loading, as might occur during subsidence or other conditions previously described, which, through the cement columns, places the portion of the casing string above the production zone 21 in tension, and the portion thereof opposite the production zone in compression. As previously described, the installation of connectors constructed in accordance with the present invention in one or both portions of the casing string makes it is possible to accommodate this axial loading and thus prevent buckling or parting of the casing which might prevent normal production from the well and damage to equipment within it.

Figure 1:
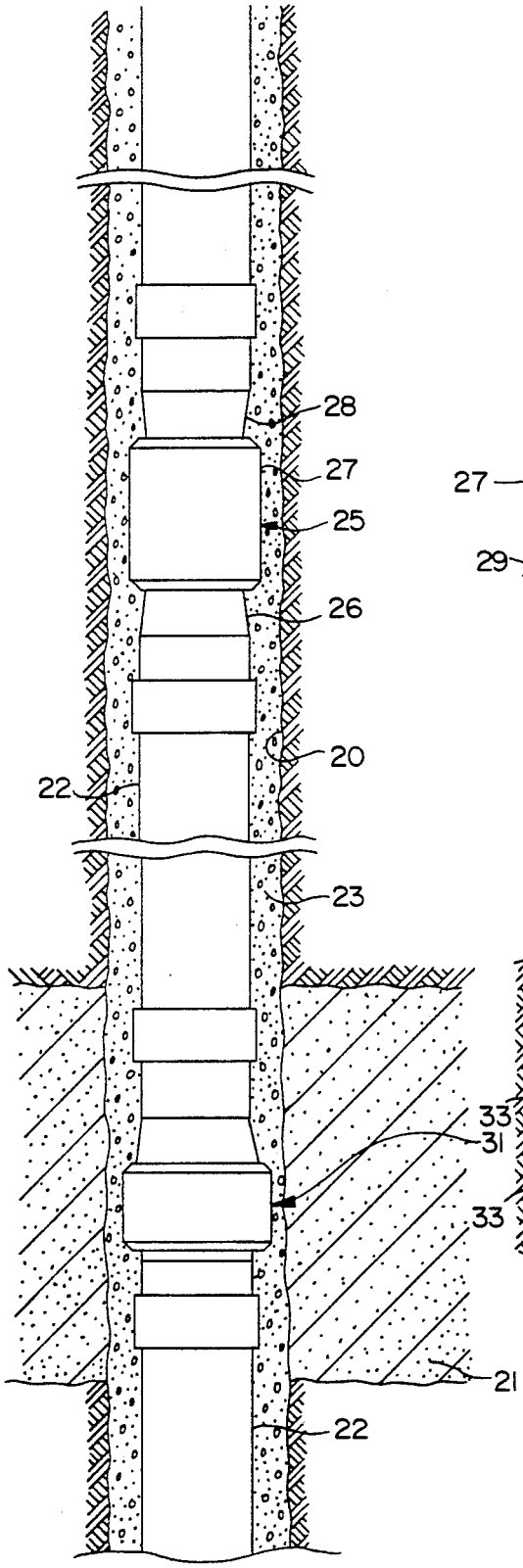
Figure 2A:
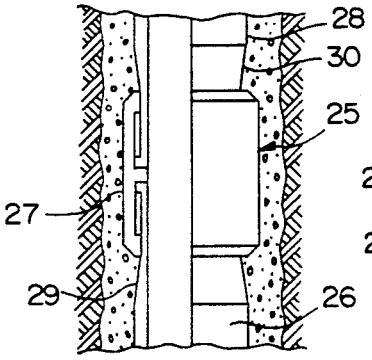
FIGS. 2A and 2B are views of the upper extendable connector, with one side shown in section, and with the tubular members of the connector in contracted positions in FIG. 2A and in their extended positions in FIG. 2B following extension of the portion of the casing string in which it is installed.
Figure 2B:
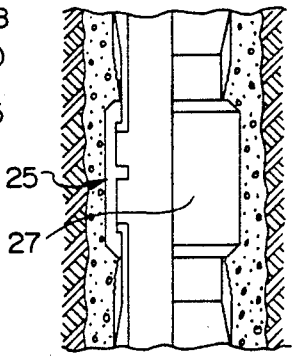

As also previously described, the upper, extendable connector, which is indicated in its entirety by reference character 25, is shown to comprise a first, lower tubular member 26 having its lower end (not shown) connectible to the casing string and its upper end telescopically and sealably reciprocable within the lower end of a second tubular member 27, and a third, upper tubular member 28 having its upper end (not shown) connected to the casing string and its lower end telescopically and sealably reciprocable within the lower end of the second tubular member 27. As shown diagrammatically in FIGS. 2A, prior to axial loading of the connector 25, each of the first and third tubular members are connected to the second tubular member in their contracted positions. However, as shown in FIG. 2B, upon axial extension of the casing string, in response to tension applied thereto, the first and third tubular members are released for movement to their extended positions with respect to the second tubular member 27.

In order to permit such movement the first tubular member has an outer conical surface 29 which is below the second tubular member and which is flared in a direction downwardly and thus in the direction of movement of the first member from its contracted to its extended position of FIG. 2B, whereby the conical surface 29 is free to move downwardly away from the adjacent portion of the cement column. In like manner, the upper tubular member 28 has a conical surface 30 which is above the tubular member 27 and which flares upwardly, and thus in the direction in which the upper tubular member is moved from its contracted to its extended position, whereby the surface 30 is also permitted to move away from the adjacent portion of the cement column.

Figure 3A:
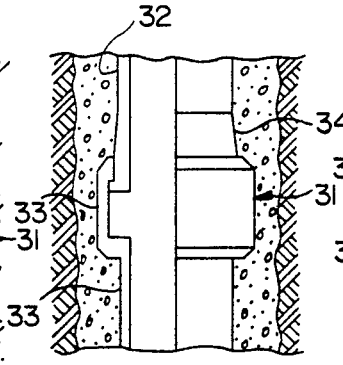
FIGS. 3A and 3B are views of the lower contractible connector, with one side thereof being shown in section, and with the connector extended prior to compressive loading of the portion of the casing string in which it is installed, as shown in FIG. 3A, and in its contracted position following compression loading of such portion of the casing string, as shown in FIG. 3B.
Figure 3B:
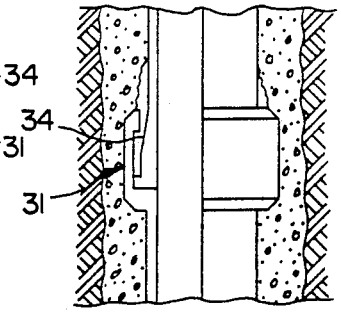

The contractible connector which is installed in the casing opposite the production zone, and which is indicated in its entirety by reference character 31, is best shown in FIGS. 3A and 3B to comprise a first, upper tubular member 32 having its upper end (not shown) connected as part of the casing string and its lower end telescopically and sealably reciprocable within the upper end of a second tubular member 33 whose lower end (not shown) is connected as part of the casing string. As shown in FIG. 3A, the first, upper tubular member 32 of the contractible connector 31 also has a conical surface 34 which, in the extended position (FIG. 3A) of the first and second members, is above the second tubular member 33 and which is flared downwardly or in a direction toward which the first tubular member is moved from its initial extended position, as shown in FIG. 3A, to its contracted position, shown in FIG. 3B, in response to axial compression of the portion of the casing string in which the connector 31 is installed. As shown in FIG. 3B, as the connector 31 is so contracted, the conical surface 34 moves downwardly away from the adjacent portion of the cement column.

Figure 4A:
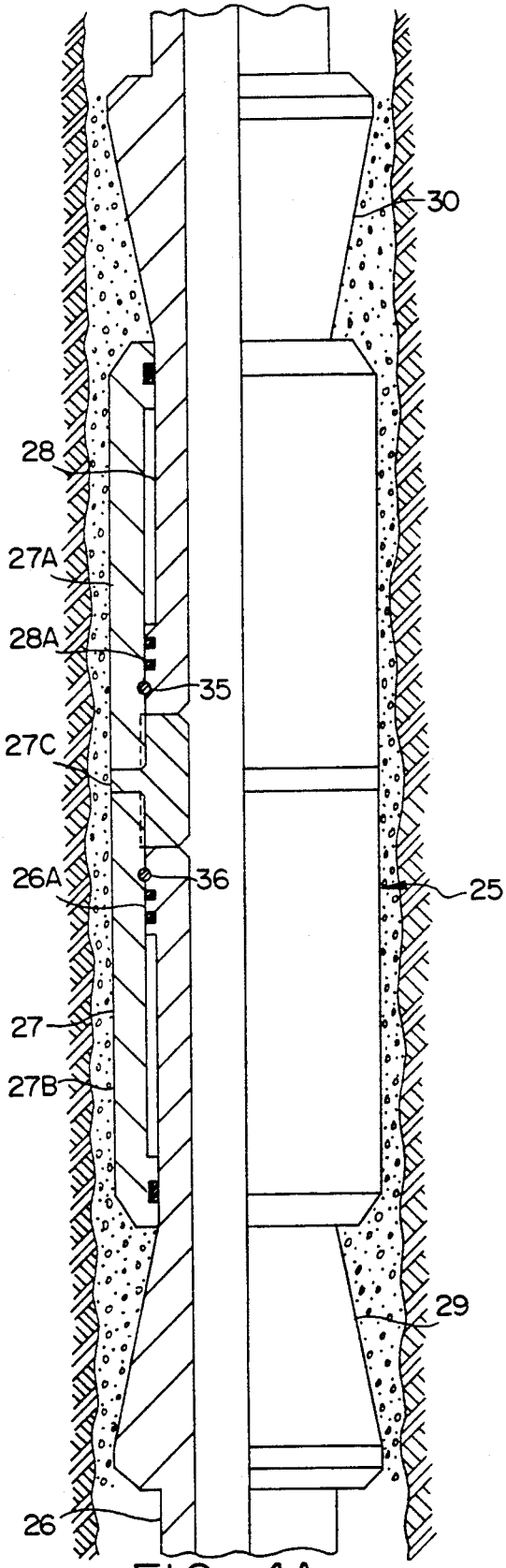
FIGS. 4A and 4B are enlarged detailed views, partly in section and partly in elevation, of the upper connector, and as seen in FIGS. 2A and 2B respectively.
Figure 4B:
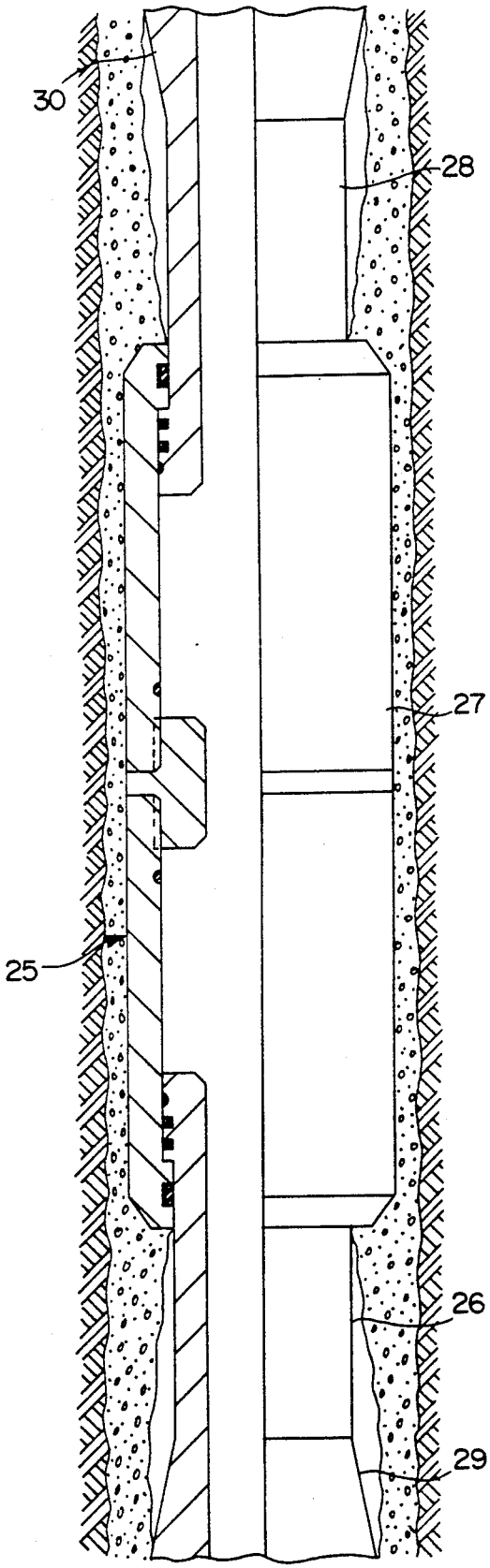

As shown in FIGS. 4A and 4B, the second tubular member 27 of the connector 25 includes upper and lower tubular sections 27A and 27B connected to one another by collar 27C generally intermediate the ends of the member 27. The upper and lower tubular sections 27A and 27B have radially enlarged inner cylindrical surfaces above and below the collar 27C and respectively below and above radially reduced cylindrical surfaces at their upper and lower ends. A piston 26A on the upper end of tubular member 26 carries seal rings for sealably sliding within the enlarged cylindrical surface of the section 27B, and a piston 28A on the lower end of the upper tubular member 28 carries seal rings which are sealably slidable within the enlarged inner cylindrical surface of the upper tubular section 27A of tubular member 27. The tubular member 26 has a reduced outer diameter portion between piston 26A and conical surface 29 which fits closely within packing carried within the radially reduced lower end of the tubular section 27B, and the upper tubular member 28 has a radially reduced outer cylindrical portion between piston 28A and conical surface 30 which is closely fittable within packing on the upper reduced inner cylindrical surface of the upper section of the member 27.

In the contracted position of the member 28, the lower end of its piston 28A engages the upper end of the collar 27, and, in the contracted position of member 26, the upper end of the piston 26A engages the lower end of the collar 27. The upper tubular member is releasably connected in its contracted position of FIG. 4A by means of shearable ring or shearable balls 35, and the lower tubular member 26 is releasably connected in its contracted position of FIG. 4A by a shearable ring or balls 36. Upon shearing of the balls 35 in response to the upwardly directed axial loading upon the member 28, it moves upwardly to its extended position at which time the upper end of the piston 28A engages the lower end of the reduced portion of the tubular section 27A, and, upon release of the shear balls 26, the lower tubular member 26 moves downwardly until the lower end of its piston 26A engages the upper end of the reduced inner diameter portion of the lower tubular section 27B, as shown in FIG. 4B.

The conical surface 30 on the upper tubular member 28 is initially just above the upper end of the tubular member 27 in the contracted position of the upper tubular member. However, as the shearable connection of the upper tubular member is released, to permit it to move upwardly to the position of FIG. 4B, the conical surface 30 moves upwardly from the adjacent surface of the cement column to the position shown in FIG. 4B.

During this movement, the outer cylindrical surface of the tubular member 28 intermediate the conical surface and the piston 28A maintains its sealing engagement with the tubular member 27 so as to maintain the integrity of the casing string. Also, such surface is engaged by the packing on the upper reduced diameter end of the member 27 to prevent the accumulation of debris within the annular space between the upper tubular member and the upper section 27A of the tubular member 27.

In like manner, the conical surface 29 is located on the lower end of a reduced cylindrical outer surface of the member 26 just below the lower end of the reduced inner diameter portion of the tubular section 27B when the tubular member 27 is in its contracted position. Thus, the piston 26A will also maintain a seal with respect to the inner surface of the tubular section 27B as the tubular member 26 moves to its expanded position, as shown in FIG. 4B, and the packing carried by the lower reduced diameter portion of the section 27B prevents the accumulation of debris within the annular space between the tubular members 27 and 26 in their contracted positions. As also shown in FIG. 4B, during extension of the tubular member 26, its conical surface 29 moves downwardly away from adjacent portions of the cement column.

Each of the conical surfaces 30 and 29 may be provided with means which will not adhere to the cement and thus prevent the initial bonding to adjacent portions of the cement column. This may consist of a coating applied to some or all of the conical surfaces, or it may consist of a sleeve or cover over the conical surfaces.

Figure 5C:
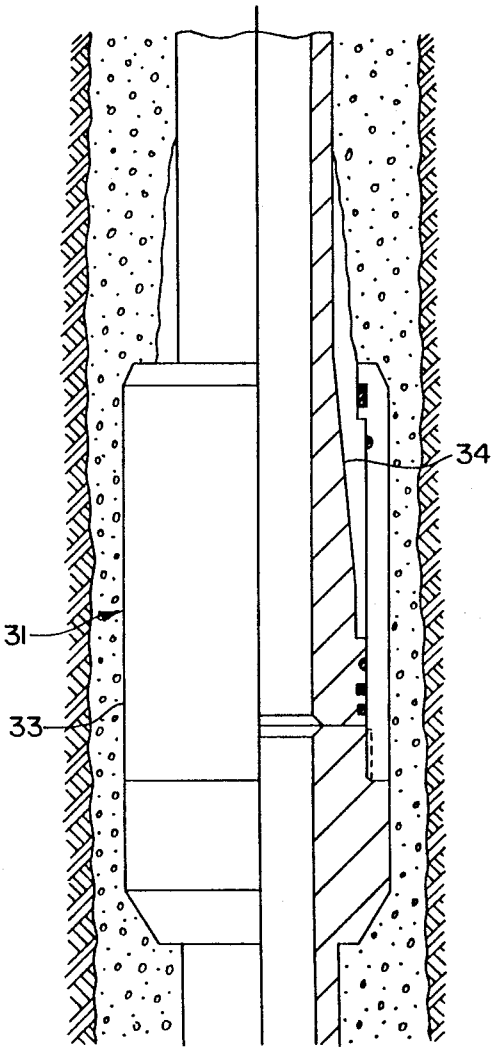
FIGS. 5A, 5B and 5C are enlarged views, partly in elevation and partly in section, of the contractible connector of FIGS. 3A and 3B, with the members thereof shown in their extended positions in FIG. 5A, in their contracted position in FIGS. 5C, and in an intermediate position in FIG. 5B.
Figure 5B:
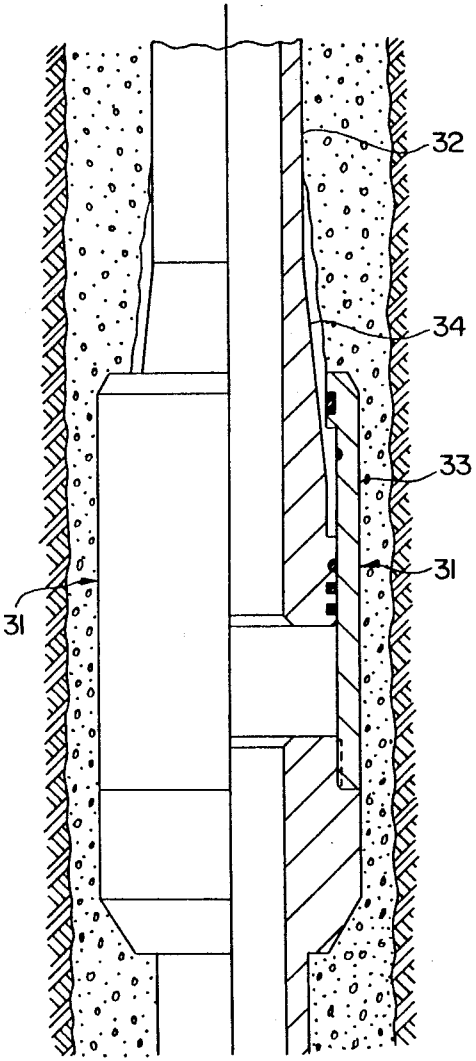
Figure 5A:
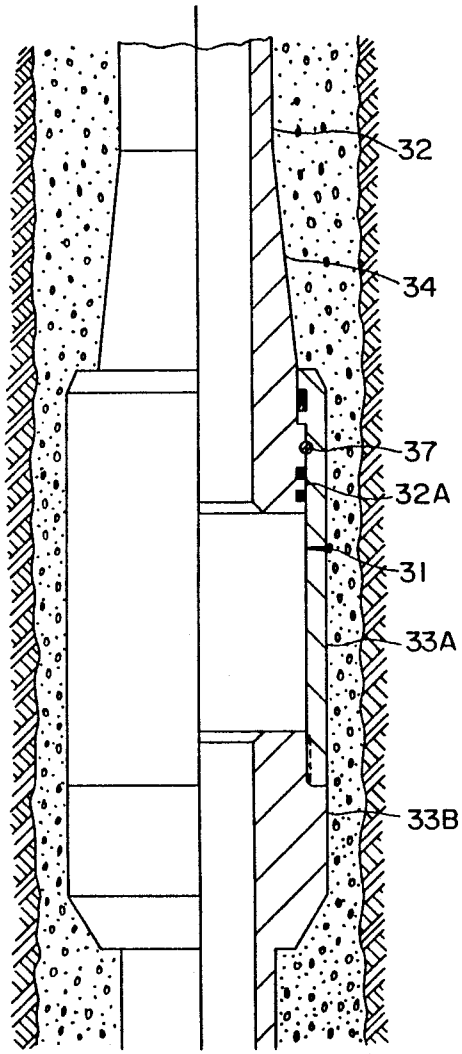

As shown in FIGS. 5A, 5B and 5C, the second tubular member of the connector 31 includes an upper tubular section 33A having an enlarged inner cylindrical surface beneath a reduced inner diameter upper end, and a lower tubular section 33B which is threadedly connected to the lower end of the section 33A and which has a bore therethrough adapted to be aligned with the bore through the casing string. The upper tubular member 32 has a piston 32A on its lower end whose seal rings are sealably slidable within the enlarged inner cylindrical surface of the tubular section 33A during movement of the upper tubular member between the extended position of FIG. 5A, the contracted position of FIG. 5C, and intermediate positions, such as that shown in FIG. 5B, thus maintaining the integrity of the connector. In its upper extended position, the upper end of the piston engages the lower end of the reduced diameter portion of the upper end of the tubular section 33A, and in its lower contracted position, the lower end of the piston 32A of the member 32 engages the upper end of the tubular section 33B.

The tubular member 32 is releasably connected in its upper extended position by means of a shear ring or shear balls 37 installed between the piston 32A and the inner cylindrical surface of the section 33A. In this position, a reduced cylindrical outer diameter surface of the member 32 between the piston 32A and conical surface 34 is closely received within packing carried on the inner diameter of the reduced upper end of the second 33A so as to prevent the accumulation of debris between the members 32 and 33 when the members are connected in their extended positions. Unlike the piston 32A, however, the packing does not seal to prevent formation of a fluid lock as the member 32 begins to move to its contracted position. Upon release of the shearable balls 37, the tubular member 32 moves downwardly to accommodate contraction of the portion of the casing string in which it is connected. As it moves downwardly, the conical surface 34 thereof moves downwardly away from the adjacent portions of the cement column. As previously noted, however, the outer surface of conical surface may be provided with a material which prevents the initial bond between it and the cement column, or with a thin cover of metal or plastic, thus facilitating release or movement of the upper tubular member to contracted position.

The alternative embodiment of the contractible connector indicated in its entirety by reference character 40 in FIGS. 6A and 6B differs from the just described contractible connector in that it includes a first upper tubular member 41 having a lower end telescopically and sealably reciprocable within the upper end of a tubular member 42, and a lower tubular member 43 having an upper end telescopically and sealably reciprocable within the lower end of the tubular member 42. As in the case of the extendable tubular connector 25, the central or intermediate member 42 comprises an upper tubular section 42A and a lower tubular section 42B connected by a collar 42C generally intermediate the upper and lower ends of the member 42. As will be further apparent from FIGS. 6A and 6B, the connector further corresponds to the connector 25 in other respects in that a piston 41A on the lower end of tubular member 41 carries seal rings which are sealably slidable within an enlarged cylindrical surface within tubular section 42A, and a piston 43A at the upper end of the tubular member 43 has seal rings which are sealably slidable within the lower tubular section 42B of the tubular member 42.

Tubular member 41 is reciprocable between the extended position of FIG. 6A in which the upper end of piston 41A engages the lower end of reduced diameter upper end of tubular section 42A and the contracted position of FIG. 6B in which it engages the upper end of connector 42C. Tubular member 43, on the other hand, is reciprocable between the expanded position of FIG. 6A in which the piston 43A engages the upper end of the reduced lower end of section 42B and an upper contracted position which the upper end of the piston engages the lower end of the collar 2C, as shown in FIG. 6B.

In other respects, however, the contractible connector 40 differs from the extendable connector 25 in that its upper and lower tubular members are releasably connected to the intermediate tubular member in their extended positions. Thus, as in the case of the contractible connector 31, upper tubular member 41 is releasably connected in its extended position by means of a shear ring or shear balls 44 installed between its piston and the enlarged inner cylindrical surface of the section 42A, and the lower tubular member 43 is releasably connected in its lower extended position by means of a shear ring or shear balls 45 installed between the piston 43A and the inner cylindrical surface of tubular section 42B.

As shown in FIG. 6B, upon shearing of the balls 44 and 45 in response to axial compressive loading on the portion of the casing string to which the connector is installed, the upper tubular member 41 moves downwardly to its contracted position, and the lower tubular member 43 moves upwardly to its contracted position. More particularly, as in the case of the tubular member 32 of the connector 31, tubular member 41 has an outer conical surface 46 above the piston 41A which flares downwardly or in a direction toward which the upper tubular member is moved from its extended to its contracted position. Similarly, the lower tubular member has a conical surface 47 thereabout below its piston 43A which is flared upwardly and thus in a direction toward which the lower tubular member is moved from its extended to its contracted position of FIG. 6B. Each of the tubular members 41 and 43 also includes a short cylindrical section intermediate its piston and its conical surface which fits closely packing carried on the inner and outer diameters of within the upper and lower ends of the tubular member 42 to prevent the accumulation of debris between the members prior to contraction of the connector, while nevertheless avoiding a fluid lock.

An alternative embodiment of the extendable connector shown in FIGS. 7A, 7B and 7C, and indicated in its entirety by reference character 50, is similar to the contractible connector 31 in that it comprises a first tubular member 51 telescopically and sealably reciprocable within a second tubular member 52. In other respects, it is similar to the lower end of the extendable connector 25 in that the upper end of the tubular member 51 extends within the lower end of the tubular member 52 for axial movement between the contracted position of FIG. 7A and the extended position of FIG. 7C, and intermediate positions such as that shown in FIG. 7B.

Thus, the tubular member 52 is made up of an upper section 52A having a bore therethrough adapted to be connected in alignment with the portion of the casing string thereabove, and a lower tubular section 52B threadedly connected to the section 52A and having an enlarged inner cylindrical surface above a reduced inner diameter lower end. The tubular member 51 carries packing 51A about its upper end for sealably sliding within the cylindrical surface of the section 52B, and a reduced outer diameter cylindrical surface beneath the piston 51B which is sealably slidable within seal rings carried by a piston 52C on the reduced inner diameter portion at the lower end of tubular section 52B. In this way, the connector maintains the integrity of the casing string while at the same time preventing the accumulation of debris between the members 51 and 52 without forming a fluid lock.

The members are held in the contracted position of FIG. 7A by means of a shear ring or shear balls 53 installed between the reduced inner diameter portion at the lower end of section 52B and the cylindrical surface of tubular section 51B. The member 51A also has an outer conical surface 54 beneath the cylindrical surface 51B thereof, which, with the tubular member 51 connected in its contracted position, as shown in FIG. 7A, is just beneath the lower end of tubular member 52. More particularly, the conical surface 54 is flared downwardly and thus in the direction in which the tubular member 51 is moved from its contracted to its extended position. Thus, as shown in FIGS. 7B and 7C, the conical surface moves axially away from adjacent portions of the cement column as the member moves downwardly from its contracted position.

From the foregoing it will be seen that this invention is one well adapted to attain all of the ends and objects hereinabove set forth, together with other advantages which are obvious and which are inherent to the apparatus.

It will be understood that certain features and subcombinations are of utility and may be employed without reference to other features and subcombinations. This is contemplated by and is within the scope of the claims.

As many possible embodiments may be made of the invention without departing from the scope thereof, it is to be understood that all matter herein set forth or shown in the accompanying drawings is to be interpreted as illustrative and not in a limiting sense.

What is claimed is:

1. In an oil or gas well having a well bore which penetrates a production zone and a casing string which is anchored in the well bore by a column of cement bonded to the casing string and well bore, the improvement comprising at least one axially extendable connector installed as a part of the casing string opposite the well bore above the formation, and at least one axially contractible connector installed as part of the casing string opposite the zone, said extendable connector including a first tubular member having one end telescopically and sealably reciprocable within the end of a second tubular member between contracted and extended positions, and means connecting the first member in its contracted position, said first member having an outer conical surface and said connection being releasable to permit said conical surface to move away from the adjacent surface of the cement column as the casing string above the zone is placed in tension, and said contractible connector including a first tubular member having one end telescopically and sealably reciprocable within the end of a second tubular member between extended and contracted positions, and means connecting the first of the contractible connectors in its extended positions, said first member of the contractible member having an outer conical surface, and said connection being releasable to permit said conical surface thereof to move away from the adjacent surface of the cement column as the casing string opposite the zone is placed in compression.

2. As in 1, wherein the extendable connector also includes a third tubular member having an end telescopically and sealably reciprocable within the opposite end of the second member thereof between contracted and extended positions, and means connecting the third member in its contracted position, said third member having an outer conical surface, and said connection being releasable to permit said conical surface thereof to move away from the adjacent surface of the cement column as the casing string above the zone is placed in tension.

3. As in 1, wherein the contractible connector also includes a third tubular member having an end telescopically and sealably reciprocable within the opposite end of the second member thereof between contracted and extended positions, and means connecting the third member in its extended position, said third member having an outer conical surface, and said connection being releasable to permit said conical surface thereof to move away from the adjacent surface of the cement columns as the casing string opposite the zone is placed in compression.

4. As in 2, wherein the contractible connector also includes a third tubular member having an end telescopically and sealably reciprocable within the opposite end of the second member thereof between contracted and extended positions, and means connecting the third member in its extended position, said third member having an outer conical surface, and said connection being releasable to permit said conical surface thereof to move away from the adjacent surface of the cement columns as the casing string opposite the zone is placed in compression.

5. As in 1, wherein a material is applied to the outer conical surface of each connector which does not adhere to the cement.

6. A connector adapted to be connected as part of a casing string which is anchored within the well bore of an oil or gas well which penetrates a production zone by a column of cement bonded to the casing string and well bore, comprising first and second tubular members adapted to be connected in alignment with portions of the casing string, the first member having an end telescopically received and sealably reciprocable within an end of the second member between contracted and extended positions, means on the members engagable with one another to locate the first member in each of its contracted and extended positions, and means connecting the members in one of said positions, said first member having an outer conical surface which is flared in the direction toward which said first member is moved from its one position toward its other position, and said connection being releasable to permit said conical surface to move axially away from the adjacent surface of the cement column in response to axial loading of said casing string.

7. As in 6, wherein the end of said first member has a piston carrying seal means slidable within an enlarged inner cylindrical surface of the second member, the second member has oppositely facing shoulders on its enlarged inner cylindrical surface, and the opposite ends of the piston are engagable with said shoulders to locate it in its contracted and extended positions.

8. As in 6, wherein the portions of the casing string are opposite the well bore above the zone, the member is releasably connected to the second member in its contracted position, and the conical surface is pulled downwardly away from the adjacent surface of the cement column when the casing string is placed in tension.

9. As in 6, wherein the portions of the casing string are opposite the production zone, the first member is releasably connected to the second member in its extended position, and the conical surface is pulled downwardly away from the adjacent surface of the cement column when the casing string is placed in compression.

10. As in 6, including a third member having an end telescopically and sealably reciprocable within the opposite end of the second member thereof between contracted and extended positions, means connecting the third member in said one position, said third member having an outer conical surface which is flared in the direction toward which said third member is moved from said one position toward its other position, and said connection being releasable to permit said conical surface thereof to move away from the adjacent surface of the cement column in response to said axial loading of said casing string.

11. As in 6, wherein a material is applied to the outer conical surface which does not adhere to the cement.

* * * * *